United States Patent [19]

DiFazio

[11] Patent Number: 5,072,547

[45] Date of Patent: Dec. 17, 1991

[54] COMBINED ALUMINUM AND WOOD FRAME FOR WINDOWS AND DOORS

[75] Inventor: Joseph DiFazio, Troy, Mich.

[73] Assignee: Acorn Building Components, Inc., Detroit, Mich.

[21] Appl. No.: 688,850

[22] Filed: Apr. 22, 1991

[51] Int. Cl.[5] ..... E06B 1/04

[52] U.S. Cl. ..... 49/504; 49/DIG. 1; 52/211

[58] Field of Search ..... 49/504, DIG. 1, 505; 52/211, 212

[56] References Cited

U.S. PATENT DOCUMENTS

| | | | |
|---|---|---|---|
| 3,402,510 | 9/1968 | Johnson | 49/504 X |
| 4,151,682 | 5/1979 | Schmidt | 49/504 X |
| 4,207,707 | 6/1980 | Holdiman et al. | 49/504 X |
| 4,324,072 | 4/1982 | Sterner, Jr. | 49/DIG. 1 X |
| 4,558,536 | 12/1985 | Dunsmoor | 49/504 X |
| 4,982,530 | 1/1991 | Palmer | 49/504 |

*Primary Examiner*—Philip C. Kannan
*Attorney, Agent, or Firm*—Harness, Dickey & Pierce

[57] ABSTRACT

A frame for a window or door is formed of inner and outer frame sections that are connected together by a thermobreak strip. The outer frame section is formed of extruded aluminum strips. The inner frame section is formed of an exterior part made of extruded aluminum strips and an interior part which is formed of wood strips. The two parts are mechanically fastened together. The inner and outer frames are roughly of the same thickness so that the thermobreak is roughly centered within the frame wherein about three-quarters of the thickness of the frame members are formed of metal, with the thermobreak arranged therein and the interior, roughly one-quarter of the frame thickness, is formed of wood. Thus, the combined aluminum and wood frame, with the thermobreak provides a structurally stable and rigid frame with an attractive appearing wood interior.

5 Claims, 1 Drawing Sheet

COMBINED ALUMINUM AND WOOD FRAME FOR WINDOWS AND DOORS

BACKGROUND OF INVENTION

This invention relates to frames for framing openings in walls within which closures, such as windows or patio doors and exterior doors and the like, are to be mounted. Such frames are commonly made of wood strips or of metal strips, which strips are joined together at their adjacent ends to provide a multi-sided frame within which the closure may be mounted.

Conventional metal frames are made of extruded aluminum strips which are provided with integral channels or guides for holding and for guiding the movement of framed closures, such as window units or patio door units or exterior doors. When properly constructed and of an appropriate thickness, conventional aluminum frames are relatively rigid, strong and structurally stable. In addition, aluminum frames are general impervious to weather conditions. Wood frames, on the other hand, are subject to weathering and require frequent painting for protection. Moreover, wood frames have less strength and structural rigidity than aluminum frames, and wood frame members frequently swell or warp, which affects the ability to move the closures mounted within such frames. But wood frames are more attractive in appearance, avoid "sweating" or condensation of atmospheric moisture, feel warmer, and have other advantages over metal frames.

Thus, it would be desirable to provide a frame which possess the strength, rigidity and structural integrity of a metal frame while providing the benefits of a wood frame. Prior attempts have been made to form composite metal and wood window frames. However, such constructions have been relatively expensive, difficult to form, and otherwise are not completely satisfactory. Thus, this invention relates to an improved composite aluminum metal and wood window construction which provides the advantages of both metal and wood in a single frame.

SUMMARY OF THE INVENTION

This invention contemplates a frame formed of an outer frame section and an inner frame section which are rigidly joined together by a thermobreak strip to provide a unitary frame construction. The outer frame section is made of metal, such as extruded aluminum, having conventional channels, rails and guides for enclosing and supporting a framed or unframed closure panel. The inner frame section is formed of two connected parts, namely, an exterior part and an interior part. The exterior part is made of metal strips, such as extruded aluminum, and is joined to the outer, metal frame by the thermobreak strip. The interior part is formed of wood strips which are mechanically joined to the adjacent exterior part. The inner, metal-wood frame and outer, all metal frame sections are roughly of the same thickness so that the thermobreak is roughly centered on the frame forming members. Thus, roughly three-quarters of the thickness of the composite frame, that is, the outer metal section and the exterior metal part, with the thermobreak are exposed at the outside of the wall of a building, while the inner, approximately one-quarter of the frame, is exposed at the inside or the room side of a building.

The wood interior part provides the warmth and attractive appearance and condensation free surface of a normal wood frame. Simultaneously, the all-metal outer section, thermobreak strip and exterior, metal frame part together provide the advantages of a conventional aluminum frame.

One object of this invention is to provide a frame which makes available the benefits and advantages of both a metal frame and a wood frame, but which produces the structural stability and strength and rigidity of a frame made entirely of metal.

A further object of this invention is to provide a frame which has the weather resistance and the structural stability and rigidity of a metal frame, while simultaneously possessing the warmth and physical appearance of an all-wood frame on the room-side of a building.

Yet another object of this invention is to provide a strong, composite metal and wood frame for doors and windows, which frame is relatively inexpensive to manufacture and which may be handled and installed by using conventional techniques, tools and labor.

These and other objects and advantages of this invention will become apparent upon reading the following description, of which the attached drawings form a part.

DETAILED DESCRIPTION

Figure 1:
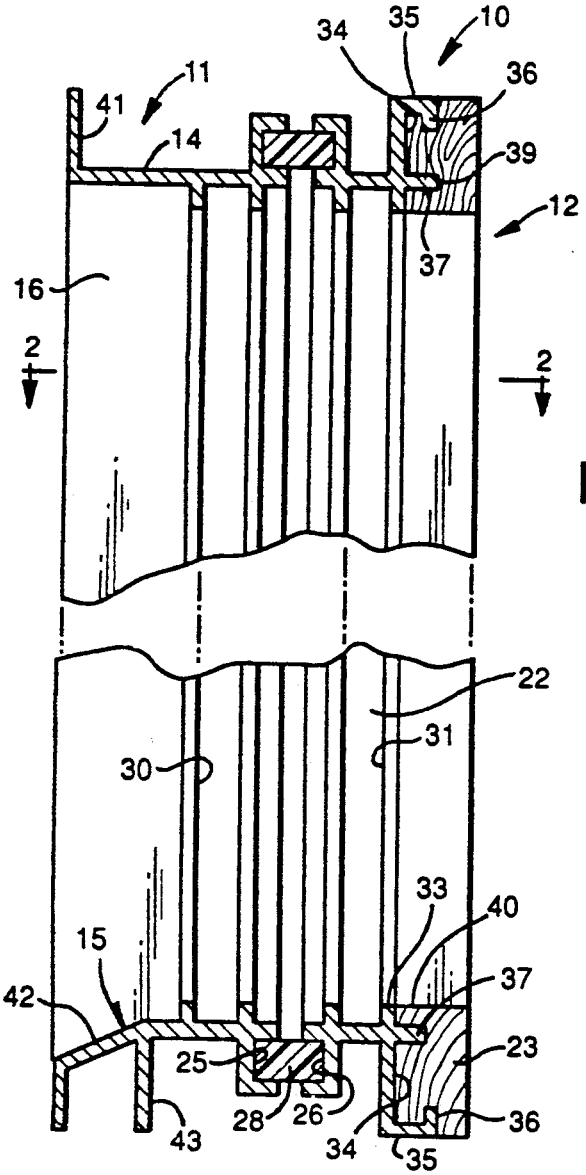
FIG. 1 is a fragmentary, elevational, cross-sectional view schematically illustrating a window frame for use with double-hung type windows.
Figure 3:
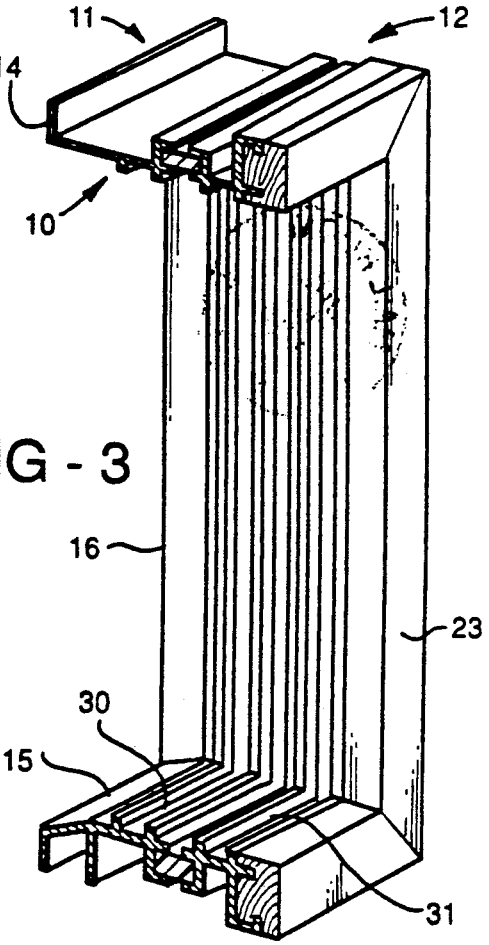
FIG. 3 is a perspective view, shown in cross-section and to a smaller scale, of the frame of FIG. 1.

FIG. 1 schematically shows, in cross-section, a frame 10 for framing a window or door opening in a building wall. For example, the frame may be used for encircling and mounting double-hung, framed windows or sliding, framed glass, patio doors, swing-hinged doors and the like. The specific cross-sectional configuration of the frame may vary considerably, depending upon the particular use requirements.

The frame is formed of an outer frame section 11, which may be made of extruded aluminum strips, and an inner frame section 12 which is made of an aluminum part and a wood part. These frame sections and the two parts of the inner frame sections are secured together to form a rigid composite structure.

The outer frame 11 is formed of an upper, header member 14, a lower, sill member 15 and side, jamb members 16. These members are rigidly connected together at their ends to form the four-sided frame. The particular kind of connections used may vary. However, such connections are conventional and the particular type used will depend upon the requirements of a particular construction, costs, etc.

The inner frame section 12 is made of two parts, namely, an exterior frame part 22, made of extruded aluminum strips, and an interior frame part 23 made of wood strip members. Similarly to the all-metal outer frame section 11, the exterior frame part 22 and interior frame part 23 are each formed of header, sill and jamb members which are connected together in a conventional manner.

An edge of outer frame section 11 is provided with a continuous channel 25 which opens towards a similar, continuous channel 26 formed on the adjacent edge of the inner frame section. A strip of thermobreak material 28 is secured within the opposing channels 25 and 26 to provide a conventional thermobreak construction. By way of example, the thermobreak may be formed of a rigid polyurethane strip, which is either poured in place in liquid form for solidification within the channels or is pre-formed and adhesively or mechanically secured within the opposed channels. Preferably, the thermobreak strip is rigid and, therefore, rigidly interconnects the all-metal outer frame section to the metal part of the wood-metal inner frame section.

The outer frame section may be formed with integral ribs which provide one or more tracks 30 within which closure panels, such as framed windows or framed doors are slidably mounted. Similarly, tracks 31 are formed on the metal, exterior frame part 22. Alternatively, ribs or stops may be formed on the frame sections for mounting unframed doors, such as exterior doors. For some purposes, the adjacent edge portion of the wood interior frame strips may form one side or leg of a track so that a track may be formed partially of a rib on the exterior metal strip and partially of the adjacent edge of a wood strip. In that case, the rib 32, shown in FIG. 1, may be eliminated, leaving the exposed edge of the adjacent wood strip to provide one leg of the track.

The wood strips and the adjacent metal strips which form the header, jambs and sill members of the inner frame section, may be secured together in a number of different ways. The drawings illustrate one way which provides a strong, durable connection that eliminates the need for adhesive which might otherwise be necessary for securing the strips together. Thus, as illustrated in the drawings, the members that form the exterior frame part are provided with integral channels 34. These channels are formed with a first leg 35 which terminates in an edge flange 36, and a shorter second leg 37.

The adjacent wood strip 23 is provided with a groove 38 for receiving the edge flange 36 of the first leg 35. In addition, another groove 39 is provided for receiving the second leg 37. Thus, a portion of the wood strip is enveloped within the channel 34. This leaves an exposed wood surface around the interior periphery 40 of the frame. Thus, a viewer, within a room, would see what appears to be a conventional wood frame within the window opening, with the exception of the barely visible narrow bead of metal formed by the rib 33. Where that rib is omitted, so that the wood forms a portion of the closure supporting track, the viewer would see only wood.

As mentioned, the aluminum strips are preferably formed of conventional configuration extrusions. Thus, for illustrative purposes, the outer aluminum frame section is shown as having an outwardly extending, peripheral framing fin 41. In addition, it may have a sloping sill upper surface 42 with the sill provided with one or more downwardly extending spacer or mounting fins 43.

Figure 4:
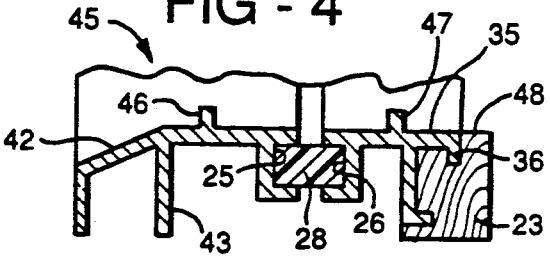
FIG. 4 is a cross-sectional view of a sill portion of a modified frame.
Figure 2:
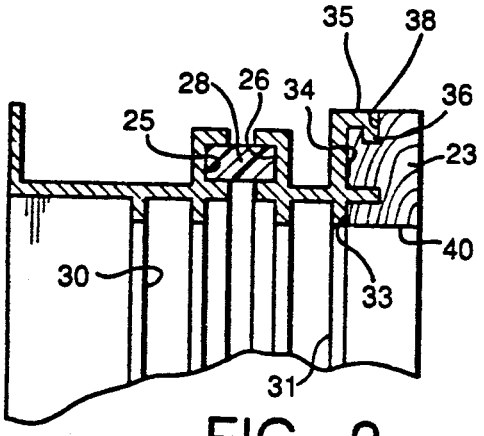
FIG. 2 is a fragmentary, cross-sectional, plan view of a side of the window frame taken in the direction of arrows 2-2 of FIG. 1.

FIG. 4 schematically shows a cross-sectional fragmentary view of an example of another wood-metal inner frame arrangement. In this case, the frame 45 may be modified for supporting horizontally slidable patio doors riding upon upwardly extending rails 46 and 47. The metal strips of the inner frame section are reversed so that the first leg 35 of the channel 34 on the metal exterior frame part, is located on the inner periphery of the frame. Therefore, the inside peripheral surface 48 of the inner frame section is partly metal and partly wood. (See FIG. 4). For some installations, a construction similar to this is desirable to provide a metal reinforced threshold or edging for the frame, particularly where the frame is used for a swinging door (i.e., without the rails 46 and 47).

Figure 5:
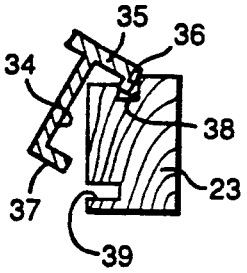
FIG. 5 is a schematic, cross-sectional view showing the initial step in connecting a wood interior frame part to the metal exterior frame part.
Figure 6:
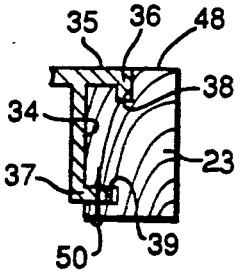
FIG. 6 is a view, similarly to FIG. 5, showing the completed connection between the wood and metal strips which form the inner frame section.

FIGS. 5 and 6 illustrate the assembly of the channel portions 34 of the metal exterior frame part with the wood strip parts. As shown in FIG. 5, the edge flange 36 of the channel of first leg 35 is aligned with the groove 38 in the wood strip. The second leg 37 is aligned with the groove 39. Then, the wood strip and the metal member are rotated relative to each other so that the second leg 37 extends into the slightly oversized groove 39.

To hold the parts together, suitable pins or brads may be driven through the wood and metal second leg 37. These pins 50 are illustrated in FIG. 6. The number of pins or brads may vary, depending upon the strength requirements. With this type of connection, adhesive is unnecessary and the parts are mechanically fastened together. The connection permits some slight relative movement between the wood and metal strips during expansions and contracting caused by changing temperature and weather conditions.

As illustrated in the drawings, the thermobreak strip is located approximately in the middle, between the interior and exterior faces, of the frame. That is, the outer all-aluminum frame section and the inner, aluminum-wood section are each of roughly the same thickness, measured traversaly of the frame. The aluminum exterior part and wood interior part, which together form the inner frame, are each of roughly the same thickness. Consequently, in traverse section, roughly three quarters of the thickness of the frame is formed of metal and the thermobreak joint while the remaining roughly one quarter of the thickness is made of wood. These relationships may vary somewhat, but as it can be seen, most of the transverse thickness of the frame is made of a rigid, structurally stable, strong material which is substantially unaffected by hot, cold or wet weather conditions. That portion of the frame need not be protected by painting or the like, although it may be painted if desirable for decorative purposes. Meanwhile, the interior, relative small traverse portion of the overall frame, is made of attractive looking and warm feeling wood which, of course, requires paint or similar types of coatings, as in conventional. Thus, within a room of a building, the frame appears to be of wood construction. Moreover, the normal sweating, resulting from cold temperature and humid conditions, which occurs with aluminum frames, is substantially eliminated. However, the frame provides the benefits of an aluminum frame because of its aluminum and thermobreak construction.

The types of closures used within these frames may vary. For example, double-hung windows or swing-out windows may be used, with appropriate tracks or guide ribs formed integral with the metal strips. Further, the frame may be used for a standard door, such as the exterior door of a house, or for sliding, framed glass patio doors.

This invention may be further developed within the scope of the following claims. Therefore, the foregoing description should be read as being merely illustrative of an operative embodiment of this invention and not in a strictly limited sense.

Having fully described an operative embodiment, it is now claimed:

1. A combined aluminum and wood, thermobreak type frame for mounting doors and windows in a building wall opening, comprising:

an outer, all-metal frame section and an inner metal-wood frame section, each section having an upper, a lower and parallel side frame members joined together to form a frame section;

the two sections being of substantially the same height and width and being vertically arranged in aligned, overlapped parallel relationship and being horizontally spaced apart a short distance;

a substantially continuous thermobreak strip formed of a material having a low thermal conductivity, bridging the space between the frame sections and securing the sections together into one unitary frame;

the two frame sections being of roughly the same transverse thickness, so that the thermobreak strip is roughly centered on the unitary frame between the outside and inside frame surfaces relative to the building wall;

the frame members forming the outer frame section being made of aluminum strips shaped in cross-section for enclosing and supporting a closure such as a window or door;

the frame members forming the inner frame section being divided into an interior frame and exterior frame part, which parts overlap and are joined together to form a composite inner frame, with the interior part being formed of strips of a wood material and the exterior part being formed of strips of aluminum, and with the wood interior part being rigidly connected to its adjacent aluminum exterior part;

whereby the thermobreak connected exterior part of the inner frame section and the outer frame section provide a rigid, strong, structurally stable, frame structure which includes the thermobreak strip for resisting the flow of heat therebetween, and with the wood interior part of the unitary frame providing a visually attractive, but less rigid and stable, frame surface for location within a room within whose wall the frame is mounted.

2. A combined aluminum and wood frame as defined in claim 1 and with the two parts of the divided inner section being roughly of similar transverse thickness, whereby roughly three quarters of the transverse thickness of the combined frame is of metal and roughly the remaining one quarter of the transverse thickness of the frame is of wood.

3. A combined aluminum and wood frame as defined in claim 2 and said exterior frame part being formed of extruded aluminum strips which, in cross-section, are shaped to enclose and support a closure such as a window or door.

4. A combined aluminum and wood frame as defined in claim 3 and said frame forming a fixed closure surrounding frame for framing an opening in an exterior building wall and for enclosing and supporting framed movable closures, such as movable framed window and framed patio door units and swinging doors.

5. A combined aluminum and wood frame as defined in claim 1, and with said thermobreak comprising a continuous, rigid, uniform cross-section, narrow, plastic strip having opposite edges which are secured within substantially continuous channels formed integral on the adjacent, spaced apart edges of the aluminum outer frame section and the aluminum part of the inner frame section.

* * * * *